US005418426A

United States Patent [19]

Rilly

[11] Patent Number: 5,418,426

[45] Date of Patent: May 23, 1995

[54] PICTURE TUBE HAVING A PLURALITY OF GUNS

[75] Inventor: Gerard Rilly, Unterkirnach, Germany

[73] Assignee: Deutsche Thomson-Brandt GmbH, Villingen-Schwenningen, Germany

[21] Appl. No.: 150,910

[22] Filed: Nov. 12, 1993

[30] Foreign Application Priority Data

Dec. 1, 1992 [DE] Germany ..... 42 40 353.7

[51] Int. Cl.[6] ..... H01J 29/98

[52] U.S. Cl. ..... 315/9; 313/2.1; 313/413; 313/427; 348/806; 348/809; 348/811

[58] Field of Search ..... 315/9; 313/2.1, 413, 313/427; 358/67, 66, 64, 230, 242

[56] References Cited

U.S. PATENT DOCUMENTS 3,289,196 11/1966 Hull ..... 315/9
4,777,407 10/1988 Takenaka ..... 315/9

*Primary Examiner*—Robert J. Pascal
*Assistant Examiner*—Reginald A. Ratliff
*Attorney, Agent, or Firm*—Joseph S. Tripoli; Dennis H. Irlbeck

[57] ABSTRACT

It is known to provide a large screen area using a picture tube having a plurality of guns. The object is to provide a transition of continuous brightness, so that the partial picture transitions are no longer perceptible.

This is achieved in that a picture tube without a shadow mask, but with optical sensors, index regions and optical walls is employed, so that a precise detection of the beam is possible and the partial picture transitions are no longer perceptible.

Especially for television receivers and monitors.

11 Claims, 2 Drawing Sheets

PICTURE TUBE HAVING A PLURALITY OF GUNS

The invention proceeds from a picture tube according to the preamble of claim 1. It is known to produce a large screen area having a screen diagonal of ≧40″, in that a plurality of guns are disposed so that a large screen area with a plurality of partial pictures is presented. In the case of such solutions, shadow masks are employed, which considerably reduce the effectiveness of the brightness and enable the partial picture transitions to be detected. The deflection of the electron beam and its brightness are not noticed or corrected.

The object of the invention is to provide a picture tube without shadow mask, having a plurality of guns, in which picture tube the partial picture transitions are not perceptible. This object is achieved by the invention indicated in claim 1. Advantageous further developments are indicated in the subclaims.

In the case of the invention, depending upon the size of the screen, a plurality of guns are disposed alongside one another in the vertical and horizontal direction. The internal surface of the screen is coated with blue, green and red vertical phosphor strips, and these are separated by optically opaque strips, preferably black matrix strips. In the black matrix strip regions, there are situated index regions which serve for the vertical and horizontal position finding of the beam. The guns disposed in the vertical direction form a column, and each column has at least one optical sensor, in order to establish the position and the brightness of the beam. In the event of deflections, readjustment takes place in the horizontal and vertical direction and the brightness is matched, so that the partial picture transitions cannot be seen.

The individual columns are separated by optical walls, which are situated on the internal surface of screen, but each gun inscribes its own partial picture on the screen. As a result of the row sequencing of the partial pictures, the entire picture is formed on the screen, in which entire picture no partial picture transition can be seen, on account of the transitions which are continuous in terms of brightness.

No shadow mask is employed with the picture tube, so that the luminous efficiency can be increased by a factor of 4 as compared with the "shadow mask principle".

In the example which follows, the invention is explained with reference to the drawing. The individual figures represent the following:

Figure 1:
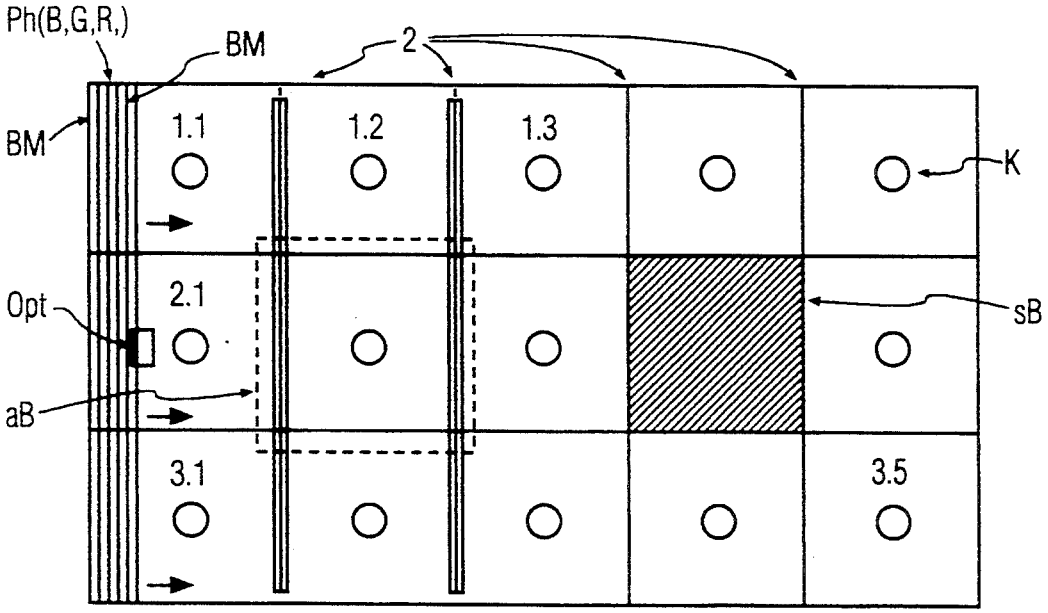
FIG. 1 represents the basic screen of the picture tube according to the invention, seen from behind.

FIG. 1 shows a screen of the picture tube, which is equipped with fifteen single-beam guns K. The arrangement of three vertical guns K in a column and the row sequencing of five columns in the horizontal direction was selected in reliance upon a format to be represented of 16:9. The picture to be represented is set up by fifteen guns K, which inscribe the partial pictures 1.1 to 3.5. The phosphor strips blue B, green G and red R are disposed vertically alongside one another and are separated by black matrix strips BM. The vertical stripwise arrangement of the phosphor strips Ph has on the one hand the advantage that differing line numbers can be projected, and on the other hand that it is possible to operate with the abovementioned single-beam guns K. Since a television picture is normally inscribed with horizontal lines, but in this case the picture is composed of vertically inscribed lines, an electronic system with a picture memory is to be provided, which system records the picture with the horizontal lines and outputs said picture in vertical lines.

An optical sensor Opt is disposed at the centre in each instance per column, in order to be able to establish the position of the individual beams in this manner. The individual columns are separated by optical walls; in this case, the optical wall exhibits a gap at the start and at the end of the column. This gap serves the adjacent sensor and the sensor of the column affected, so that the optical sensors Opt perceive the position and the brightness of the adjacent beams and thus a matching between the partial pictures is undertaken. The course of the beam in a column is synchronous, so that the information on column start and column end is advantageously utilized, in order to monitor the synchronization and, if appropriate, to match the same. The scanned region aB is larger than the visible region sB.

Figure 2:
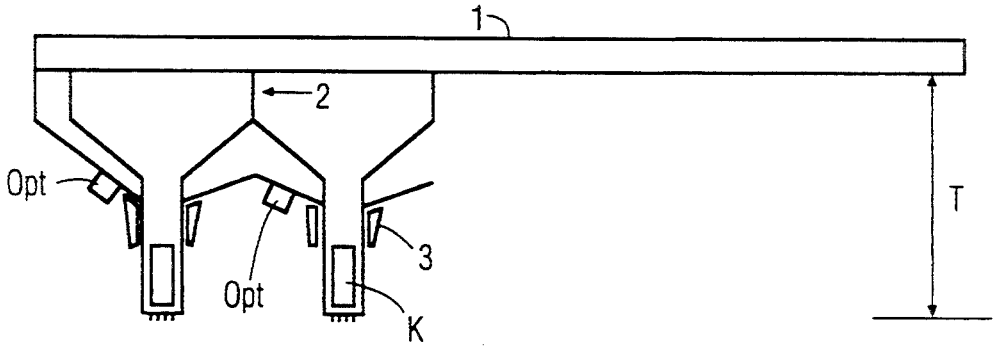
FIG. 2 represents the basic screen of the picture tube according to the invention, seen from above.

FIG. 2 shows the picture tube seen from above; in this case, it is possible to see the optical sensor Opt for a column, the deflection yoke of the picture tube and the guns K. It can be seen that the angular range of a gun which is to be represented is small, approximately 40°. For this reason, the picture tube can manage with a smaller depth T. The optical walls 2 separate the respective columns from one another.

Figure 3:
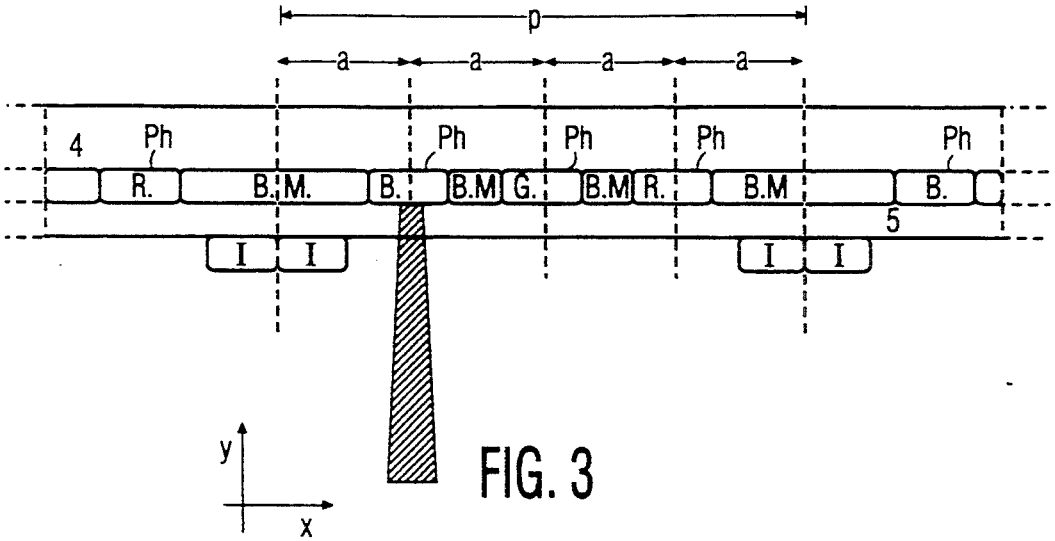
FIG. 3 represents the coating of a screen portion, seen from above.

FIG. 3 shows the coating of a screen portion, seen from above. The vertical phosphor strips pH in blue B, green G and red R as well as the black matrix regions BM are disposed between the glass 4 of the front surface and the aluminium layer 5 on the rear surface, on which the index regions I are situated. The length of a pixel p extends from the centre of an index region I to the centre of the following index region I in the X direction; in this case, the phosphor strips blue B, green G and red R lie therebetween and a pixel p is subdivided into four equal distances a. It is also possible to integrate the index regions I into the black matrix regions BM as well.

Figure 4:
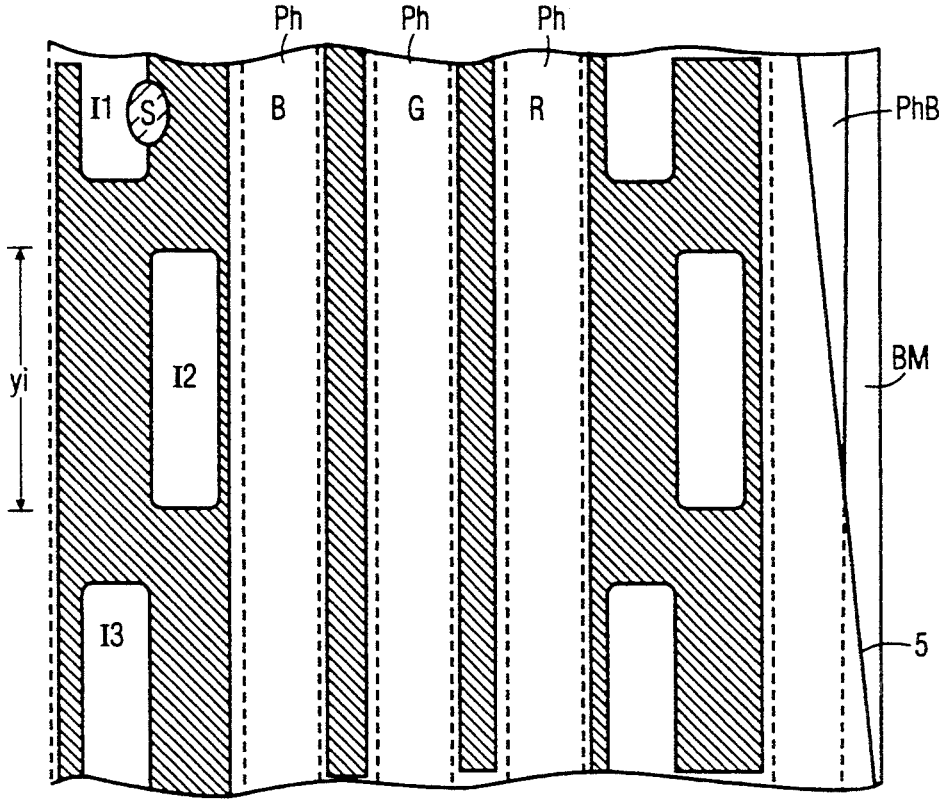
FIG. 4 represents the coating of a screen portion, seen from behind.

FIG. 4 shows the coating of the screen portion according to FIG. 3, seen from behind. In this representation, the subdivision of the index regions I can be seen; in this case, the index regions I are offset by their width, and lie in the vertical direction on the same optical axis. The distance between the index regions I is ri; in this case, the length yi of an index region I amounts to more than four spot lengths. The light spot or spot S generated by the beam is elliptical; in this case, the length of the ellipse is further extensible. However, the width of the spot must be matched to the phosphor strips Ph. The spot inscribes in succession the vertical lines, in that it at first inscribes over the index regions I, thereafter blue B, green G and red R. The index regions are disposed so that, when the spot is situated too far to the left of the vertical direction, the indices I1 and I3 project more light than index I2 and that in this way, as a result of the amplitude difference, the deflection is measured and is readjusted by influencing the beam deflection by the deflection yokes 3. When the spot strikes the region ri between two vertical indices I, no light is generated any more, so that the vertical spot position is detected.

Since the picture information to be inscribed is situated in a memory, the latter is accordingly altered when a readjustment with reference to the index regions has been detected, so that the phosphor strips blue B, green G and red R are correctly driven. Less video memory capacity is required for the display of a picture, since the single-beam gun K does indeed inscribe the four strips in a vertical direction very rapidly, but the required information is less than where three guns inscribe the respective colours. In the case of one colour, e.g. green, only this information is required and the other two phosphor strips blue B and red R are inscribed in black. The very rapid mode of inscription of the individual strips is advantageously curtailed, since each gun K actually inscribes only one partial picture.

I claim:

1. Picture tube having a plurality of guns, in which each gun represents a partial picture, so that an overall picture is formed without partial picture transitions, characterized in that, the screen is coated with vertically disposed phosphor colour strips (Ph), index regions (I) and optically opaque strips (BM), in which the guns are designed as single-beam guns (K) and at least one optical sensor (Opt) is associated with the guns (K) situated in the vertical, wherein the index regions (I) and optical sensors (Opt) are provided for the detection of the positions and brightness of the beam spots and the gun set up the partial pictures by vertically deflected beams.

2. Picture tube according to claim 1, characterized in that the screen is coated with blue (B), green (G) and red (R) vertical phosphor strips (Ph), and these are separated by optically opaque strips (BM), preferably black matrix strips (BM).

3. Picture tube according to claim 1, characterized in that index regions (I) are situated on or in the optically opaque strips (BM).

4. Picture tube according to claim 1, characterized in that at least one optical sensor (Opt) is associated with the vertically disposed guns (column).

5. Picture tube according to claim 1, characterized in that the vertically disposed guns (column) are separated from one another by optical walls (2).

6. Picture tube according to claim 1, characterized in that the optical walls (2) exhibit gaps.

7. Picture tube according to claim 1, characterized in that the vertically disposed guns (column) are synchronously driven.

8. Circuit for a picture tube according to claim 1, characterized in that a picture comprising horizontal lines is stored in a memory and an outputting of the vertical lines takes place.

9. A picture tube having a plurality of guns arranged in vertical columns and horizontal rows, in which each gun projects a single electron beam and forms a portion of a picture on a screen of said tube, characterized in that the screen is coated with vertically disposed phosphor colour strips, optically opaque strips between the colour strips and index regions located behind the opaque strips, and at least one optical sensor is associated with the guns situated in each vertical column, wherein the optical sensors sense outputs from the index regions in areas, each of which is slightly larger than the portion of a picture formed by a single gun, and said outputs are related to the positions and brightness of electron beam spots on the screen, whereby an overall picture can be formed without partial picture transitions by utilizing the sensed position and brightness information to control the position and brightness of adjacent guns.

10. The picture tube according to claim 9, wherein said tube includes vertical walls between the portions of a picture that have gaps therein at the ends of the columns, whereby the optical sensors can sense the output from the index regions in adjacent screen portions.

11. The picture tube according to claim 9, wherein each of said index regions includes two horizontally spaced columns of subdivision regions wherein the subdivision regions in one column are vertically spaced from the subdivision regions in the other column.

* * * * *